US008048009B2

(12) United States Patent
Porter, Jr. et al.

(10) Patent No.: US 8,048,009 B2
(45) Date of Patent: Nov. 1, 2011

(54) CLAMPING DEVICE FOR THERAPEUTIC APPLICATIONS

(76) Inventors: Ralph H. Porter, Jr., Cazenovia, NY (US); Eli Guterman, Syracuse, NY (US)

( * ) Notice: Subject to any disclaimer, the term of this patent is extended or adjusted under 35 U.S.C. 154(b) by 778 days.

(21) Appl. No.: 12/172,632

(22) Filed: Jul. 14, 2008

(65) Prior Publication Data

US 2010/0010402 A1 Jan. 14, 2010

(51) Int. Cl.
*A61H 7/00* (2006.01)

(52) U.S. Cl. ..... 601/133; 601/134; 24/455; 606/201

(58) Field of Classification Search ..... 601/133, 601/134; 606/201, 204, 205–207, 211; 24/455, 24/489, 490
See application file for complete search history.

(56) References Cited

U.S. PATENT DOCUMENTS

| | | | | |
|---|---|---|---|---|
| 4,770,401 | A | 9/1988 | Donaldson | |
| 5,085,207 | A | 2/1992 | Fiore | |
| 5,584,854 | A * | 12/1996 | Minarik | 606/201 |
| 5,666,964 | A * | 9/1997 | Meilus | 600/557 |
| 6,241,693 | B1 | 6/2001 | Lambden | |
| 6,340,154 | B1 | 1/2002 | Young | |
| 6,494,851 | B1 * | 12/2002 | Becher | 601/133 |
| 6,638,295 | B1 | 10/2003 | Schroer et al. | |
| 6,758,098 | B1 | 7/2004 | Nunnelee | |
| 7,134,950 | B2 | 11/2006 | Lamers et al. | |
| 7,219,885 | B2 | 5/2007 | Nardozza | |
| 2002/0151930 | A1 * | 10/2002 | Mills | 606/204 |
| 2002/0156502 | A1 * | 10/2002 | Tuan | 607/2 |
| 2004/0267174 | A1 | 12/2004 | Meisch | |
| 2005/0222608 | A1 * | 10/2005 | Hou et al. | 606/204 |
| 2006/0043661 | A1 | 3/2006 | Nardozza | |
| 2007/0051213 | A1 | 3/2007 | Tyler | |
| 2007/0138724 | A1 | 6/2007 | Gibbons et al. | |
| 2007/0167889 | A1 | 7/2007 | Kim | |

FOREIGN PATENT DOCUMENTS

| | | |
|---|---|---|
| EP | 1911431 A2 | 4/2008 |
| WO | WO-2004014283 | 2/2004 |
| WO | WO-2007087063 | 8/2007 |

OTHER PUBLICATIONS

International Search Report and Written Opinion of the International Searching Authority for PCT/US2009/050026 mailed Sep. 1, 2009 (8 pgs).

* cited by examiner

*Primary Examiner* — Michael A. Brown
(74) *Attorney, Agent, or Firm* — Harris Beach PLLC

(57) ABSTRACT

A clamping device for therapeutic applications can comprise an extended handle, a powered linear actuator mounted to the extended handle, and a C-shaped clamp attached to the extended handle and including a stationary jaw. The actuator can be configured to provide reversible axial movement of a movable member. The clamping device can further include a pair of applicators attached to the stationary jaw and to the movable member, respectively. The applicators can be made of an hypoallergenic material configured not to cause an adverse reaction when applied to a human skin. The clamping device can further include a switch configured to control the linear actuator. The linear actuator can be configured, responsive to switching the switch, to axially move the second applicator towards and away from the first applicator, thus applying pressure to a targeted body area.

19 Claims, 2 Drawing Sheets

CLAMPING DEVICE FOR THERAPEUTIC APPLICATIONS

FIELD OF THE INVENTION

This invention is generally related to devices for therapeutic applications, and more particularly to a clamping device for therapeutic massage applications.

BACKGROUND OF THE INVENTION

Traditionally, a massage therapist uses his or her hands to apply pressure to a targeted area of a client's body. For example, stimulating a body area by using a pincer grip performed by the thumb and index fingers of the therapist has proven to be one of the most effective methods of massage therapy. A therapist can stimulate a targeted body area employing the pincer grip until the client would feel muscle relaxation in the affected area, responsive to which the therapist can intensify the grip to propagate the pressure to the deeper tissues. However, a strong grip can relatively quickly lead to therapist's tiredness, making for the therapist difficult if not impossible to maintain the level of pressure needed for successful therapy. Thus, the need exists for a clamping device simulating or augmenting the pincer grip and other manipulations performed by a massage therapist.

SUMMARY OF THE INVENTION

In one embodiment of the present invention, there is provided a clamping device for therapeutic applications comprising: an extended handle adapted to facilitate a secure grip of the clamping device by an operator's hand; a powered linear actuator mounted to the extended handle and including a movable member, the actuator configured to provide reversible axial movement of the movable member; a C-shaped clamp attached to the extended handle, the clamp including a stationary jaw; a first applicator attached to the stationary jaw; a second applicator attached to the movable member; a switching means coupled to the linear actuator, the switching means configured to control the linear actuator; wherein the two applicators are made of an hypoallergenic material configured not to cause an adverse reaction when applied to a human skin; and wherein the linear actuator is configured, responsive to switching the switching means, to axially move the second applicator towards or away from the first applicator, so that to apply pressure to a targeted body area.

In one aspect, the clamping device can be configured to be used to simulate a pincer grip movement by a massage therapist.

In another aspect, the linear actuator can be selected from the group consisting of: an electrically powered linear actuator, a pneumatically driven linear actuator, and a hydraulically driven linear actuator.

In another aspect, the first applicator can be removably attached to the stationary jaw, and the second applicator can be removably attached to the movable member.

In another aspect, the clamping device can be configured so that the first applicator and the second applicator apply a pre-selected level of pressure to the targeted body area.

In another aspect, the clamping device can be configured to measure pressure applied to the targeted body area.

In another aspect, at least one of the two applicators can be configured to be heated to a pre-defined temperature.

In another aspect, at least one of the two applicators can be configured to vibrate with a pre-defined frequency.

In another aspect, the clamping device can be configured not to exceed a pre-defined maximum level of pressure applied to the targeted body area.

In another aspect, the switching means can be provided by an electric switch having two or more positions for initiating reversible movement of the movable member in two opposite directions.

In another aspect, the hypoallergenic material can be provided by a material selected from the list consisting of: an elastomeric material, plastic, rubber, ceramic, and silicone.

In another aspect, the clamping device according to the invention can further comprise an electrical nerve stimulation unit including one or more electrical signal generators and a plurality of electrodes, each of the electrodes being attached to one of: the first applicator, the second applicator.

In another aspect, the clamping device according to the invention can be configured to employ an external electrical nerve stimulation unit, wherein the clamping device can further comprise a plurality of electrodes, each of the electrodes being attached to one of: the first applicator, the second applicator, each of the electrodes being electrically coupled to a sockets configured to receive a plug electrically coupled to the external electrical nerve stimulation unit.

In another aspect of the present invention, there is provided a method of performing stimulating therapy comprising the steps of: providing a clamping device for therapeutic applications, the clamping device comprising a powered linear actuator including a movable member, a C-shaped clamp including a stationary jaw, a switching means coupled to the linear actuator, the linear actuator configured to provide reversible axial movement of the movable member; selecting at least one of: a first applicator and a second applicator, the two applicators made of an hypoallergenic material configured not to cause an adverse reaction when applied to a human skin; removably mounting at least one of: the first applicator to the stationary jaw, the second applicator to the movable member; using the switching means, actuating the linear actuator to axially move the second applicator towards or away from the first applicator, so that to apply pressure to a targeted body area.

In one aspect, the method of performing stimulating therapy can further comprise a step of selecting at least on one operating parameter of the clamping device, preceding the step of actuating the linear actuator.

In another aspect, the method of performing stimulating therapy can further comprise a step of changing at least on one operating parameter of the clamping device, responsive to at least one of: an expiration of a pre-defined timeout, a client reaction.

In another aspect, the operating parameter can be selected from the group consisting of: a level of pressure to be applied to the targeted body area; a maximum level of pressure not to be exceeded by the clamping device; and a parameter of vibration of at least one of: the first applicator, the second applicator.

In another aspect, the method of performing stimulating therapy can further comprise a step of de-actuating the linear actuator, responsive to at least one of: an expiration of a pre-defined timeout, a client reaction.

BRIEF DESCRIPTION OF THE DRAWINGS

The drawings are not necessarily to scale, emphasis instead generally being placed upon illustrating the principles of the present invention. In the drawings, like numerals are used to indicate like parts throughout the various views.

DETAILED DESCRIPTION OF THE INVENTION

Figure 1:
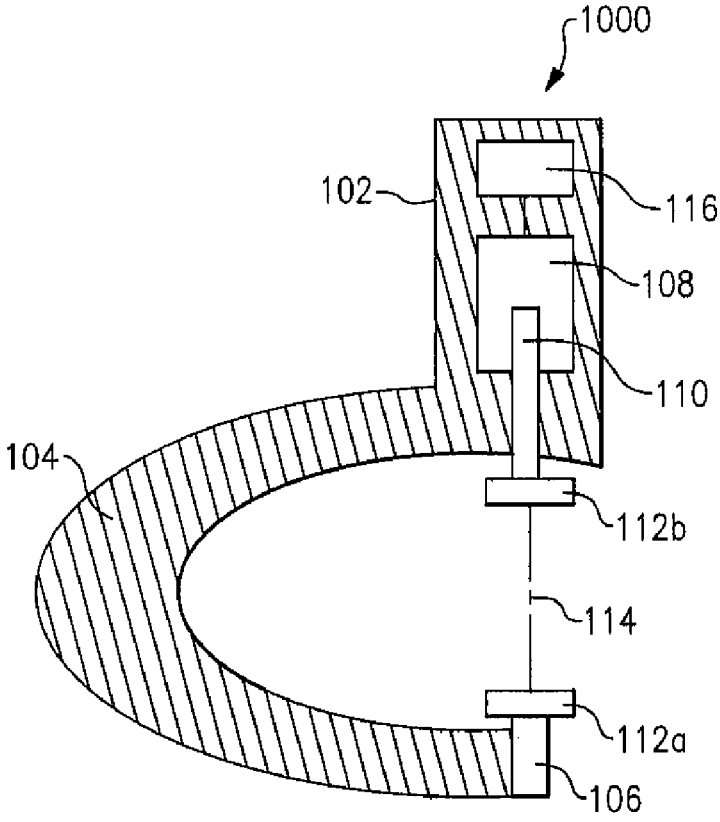
FIG. 1 illustrates a schematic view of one embodiment of a clamping device for therapeutic applications according to the present invention.

There is provided a clamping device for therapeutic applications, e.g., for simulating a pincer grip action by a therapist. One embodiment of the clamping device according to the present invention is shown in FIG. 1. The clamping device 1000 can comprise an extended handle 102 adapted to facilitate a secure grip of the clamping device by an operator's hand, a C-shaped clamp 104 which can be attached to the handle 102 and which can include a stationary jaw 106, and a powered linear actuator 108 which can be mounted to the handle 102 and which can include a movable member 110. In one embodiment, the linear actuator 108 can be mounted inside the handle 102. A skilled artisan would appreciate the fact that other ways of mounting the linear actuator 108 to the handle 102 are within the scope and the spirit of the invention.

Two applicators 112*a*-112*b* made of an hypoallergenic material can be attached to the stationary jaw 106 and to the movable member 110, respectively. The linear actuator can cause reversible axial movement of the movable member 110 along the longitudinal axis 114 towards or away from the stationary jaw 106. In operation, the clamping device according to the present invention can be used to apply constant or variable pressure to a targeted body area, by an operator holding the handle 102 or the C-shaped clamp 104 and placing applicators 112*a* and 112*b* around the body area and actuating the linear actuator 108. During the treatment, the operator can support the device by hand, to prevent the device from slipping. Upon completing the treatment session, the linear actuator can be reversed so that the clamping device can be safely removed.

Figure 2:
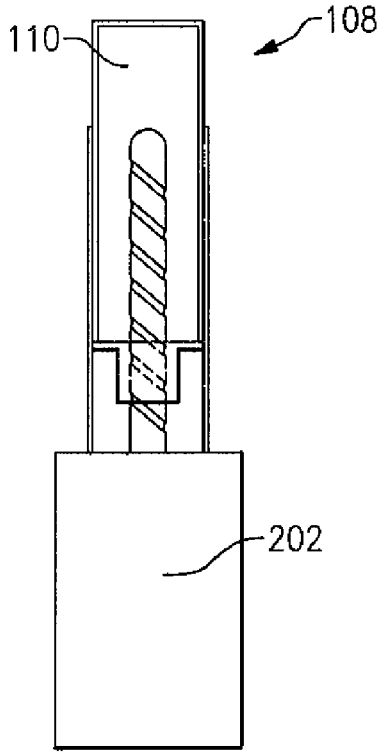
FIG. 2 illustrates a schematic cross-section view of one embodiment of a linear actuator employed by the clamping device according to the present invention.

In one aspect, the linear actuator 108 can convert a rotary motion provided by a rotary driver 202 into reversible axial movement of the movable member 110, e.g., via a lead screw 204 having a helical thread running along its length, as best viewed in FIG. 2. The movable member 110 can be provided by a shaft or a rod. The parameters of the helical thread can affect the speed of axial movement of the movable member 110, and the force applied by the movable member 110. In one embodiment, the rotary driver can be provided by an electric motor. In one aspect, the electric motor can be powered by one or more replaceable and/or rechargeable batteries. In another embodiment, the linear actuator can be driven by a variable electro magnet.

In another embodiment, the linear actuator can be pneumatically or hydraulically driven, and can contain a hollow cylinder having a piston inserted in it, so that the two sides of the piston can alternately be pressurized or depressurized to achieve reversible axial movement of the piston attached to the movable member 110.

In one embodiment, the linear actuator 108 can be provided by a commercially available linear actuator, e.g., L12 Miniature Linear Actuator available from Firgelli Technologies of Surrey, British Columbia, Canada. A skilled artisan would appreciate the fact that other types of linear actuators are within the scope and the spirit of the invention.

In another aspect, the linear actuator 108 can be controlled by a switch 116. In one embodiment, the switch can be provided, e.g., by an electrical switch coupled to the linear actuator 108. The switch can control the voltage supplied to the electric motor or to the electro magnet. In another embodiment, the switch can be provided, e.g., by a hydraulic or pneumatic switch. The switch can have a plurality of positions corresponding to different modes of operation of the linear actuator. In one embodiment, the switch can have one "off" position and two "on" positions for initiating the reversible movement of the movable member 110 in the two opposite directions along the longitudinal axis 114. In another embodiment, the switch can be provided by a push button cyclically switching between the "off" position and two "on" positions for initiating the reversible movement of the movable member 110 in the two opposite directions along the longitudinal axis of the movable member 110. In accordance with the push button embodiment, each time the push button is pressed, the linear actuator can be switched into a next operating mode selected from a list comprising the "no movement," "movement in a first direction," and "movement in a second direction" modes in a cyclic manner so that the first mode from the list is selected when the end of the list has been reached.

In another embodiment, a separate push button can be provided initiating a vibrating movement of the applicators 112-112*b*. In another embodiment, the clamping device can comprise a microcontroller controlling different operating modes of linear actuator 108. A skilled artisan would appreciate the fact that other types of switching devices are within the scope and the spirit of the invention.

In another aspect, the clamping device according to the invention can measure the pressure applied by the applicators 112*a*-112*b* to the targeted body area. In one embodiment, the pressure can be measured by a loaded spring mounted between the movable member 110 and a rotary driver 202. In another embodiment, the pressure can be estimated by measuring the voltage drop on the terminals of the electric motor. In a yet another embodiment, the pressure can be estimated by measuring the pneumatic or hydraulic pressure applied to the movable member 110. A skilled artisan would appreciate the fact that other methods of measuring the pressure applied by the applicators 112*a*-112*b* to the targeted body area are within the scope and the spirit of the present invention.

In one aspect, the clamping device according to the present invention can be used by a therapist administering massage therapy to a client, to apply constant or variable pressure to the targeted body area. In another aspect, the clamping device according to the present invention can be used by a person administering therapy to himself or herself without the assistance of a therapist, e.g., in a situation when a therapist is not available.

In another aspect, the operator of the clamping device (e.g., a therapist) can pre-select a level of pressure applied by the applicators to the targeted body area. In a further aspect, the device operator can further adjust the level of pressure or the distance between the two applicators in course of the treatment, e.g., upon expiration of a pre-defined timeout or responsive to the client's reactions.

In a further aspect, the device manufacturer or operator can pre-set a maximum level of pressure applied to the targeted body area which should not to be exceeded by the clamping device, thus preventing the clamping device from applying excessive pressure to a body area.

In another aspect, the applicator 112*b* attached to the movable member 110 can be caused to vibrate with a pre-defined frequency and amplitude. In one embodiment, the vibration can be caused by the linear actuator 108 causing the movable member 110 to perform reversible movements of small amplitude at a pre-defined frequency along the axis 114. In another embodiment, the applicators 112*a*-112*b* can include a membrane which can be caused to vibrate at, e.g., ultrasound frequencies. A skilled artisan would appreciate the fact that other methods to provide vibration of applicators 112*a*-112*b* are within the scope and the spirit of the invention.

In another aspect, the clamping device according to the invention can be adapted to perform electrical nerve stimulation, e.g., Transcutaneous Electrical Nerve Stimulation (TENS). In one embodiment, the clamping device according to the invention can comprise a TENS unit including one or more electrical signal generators and a set of electrodes. The electrodes can be attached to one or both applicators 112*a*-112*b*. In another embodiment, the clamping device according to the invention can be adapted to use en external TENS unit, by providing two or more sockets electrically coupled to the electrodes attached to one or both applicators 112*a*-112*b*. The sockets can be adapted to receive plugs electrically coupled to the electrode wires of the external TENS unit.

In a further aspect, the operator can select the stimulation level of the TENS unit to suppress pain signals to the brain, using the user interface controls of the existing TENS unit or the user interface controls provided on the clamping device.

In another aspect, the applicators 112*a*-112*b* can be made field replaceable, so that the operator of the clamping device could select and install the applicators having a configuration most suitable for the currently performed task. The configuration factors of the applicators 112*a*-112*b* can include, e.g., form or material of the applicators.

In one embodiment, one or both applicators 112*a*-112*b* can be made of a hypoallergenic material which does not cause an adverse reaction when applied against human skin, including e.g., elastomeric material, plastic, rubber, ceramic, or silicone.

In another aspect, the applicators 112*a*-112*b* can be provided in various form factors. In one embodiment, the applicators 112*a*-112*b* can be provided by flat surfaces. In another embodiment, the applicators 112*a*-112*b* can be provided by small curved surfaces simulating a finger tip. In another embodiment, the applicators 112*a*-112*b* can be provided by oversized curved surfaces adapted to support the targeted body area. In another embodiment, the applicators 112*a*-112*b* can be provided by wedge shaped surfaces adapted to prevent the clamping device from slipping.

A skilled artisan would appreciate the fact that other configuration factors of the applicators 112*a*-112*b* are within the scope and the spirit of the present invention.

In another aspect, one or both applicators can be configured to be heated to a pre-defined temperature, to augment the therapeutic effect of the constant or variable pressure applied to a targeted body area. In one embodiment, the applicators can be pre-heated using an external heating device, e.g., by placing the applicators into a container containing hot water. In another embodiment, the clamping device according to the invention can comprise one or more electric heating elements adapted to heat the applicators 112*a*-112*b*. In one embodiment, the clamping device according to the invention can further comprise a microcontroller adapted to control the heating elements.

In another aspect, the clamping device according to the invention can include a push button controlling the vibration of the applicators 112*a*-112*b*. In one embodiment, the push button can switch the vibrating mode between "on" and "off" positions. In another embodiment, the push button can cyclically switch between two or more vibrating modes having pre-set vibration frequencies and/or amplitudes. In accordance with the push button embodiment, each time the push button is pressed, a next vibrating mode selected from a list comprising two or more vibrating modes having pre-set vibration frequencies and/or amplitudes in a cyclic manner so that the first mode from the list is selected when the end of the list has been reached.

In another embodiment, the clamping device according to the invention can comprise a microcontroller controlling vibration mode of the applicators 112*a*-112*b*.

Figure 3:
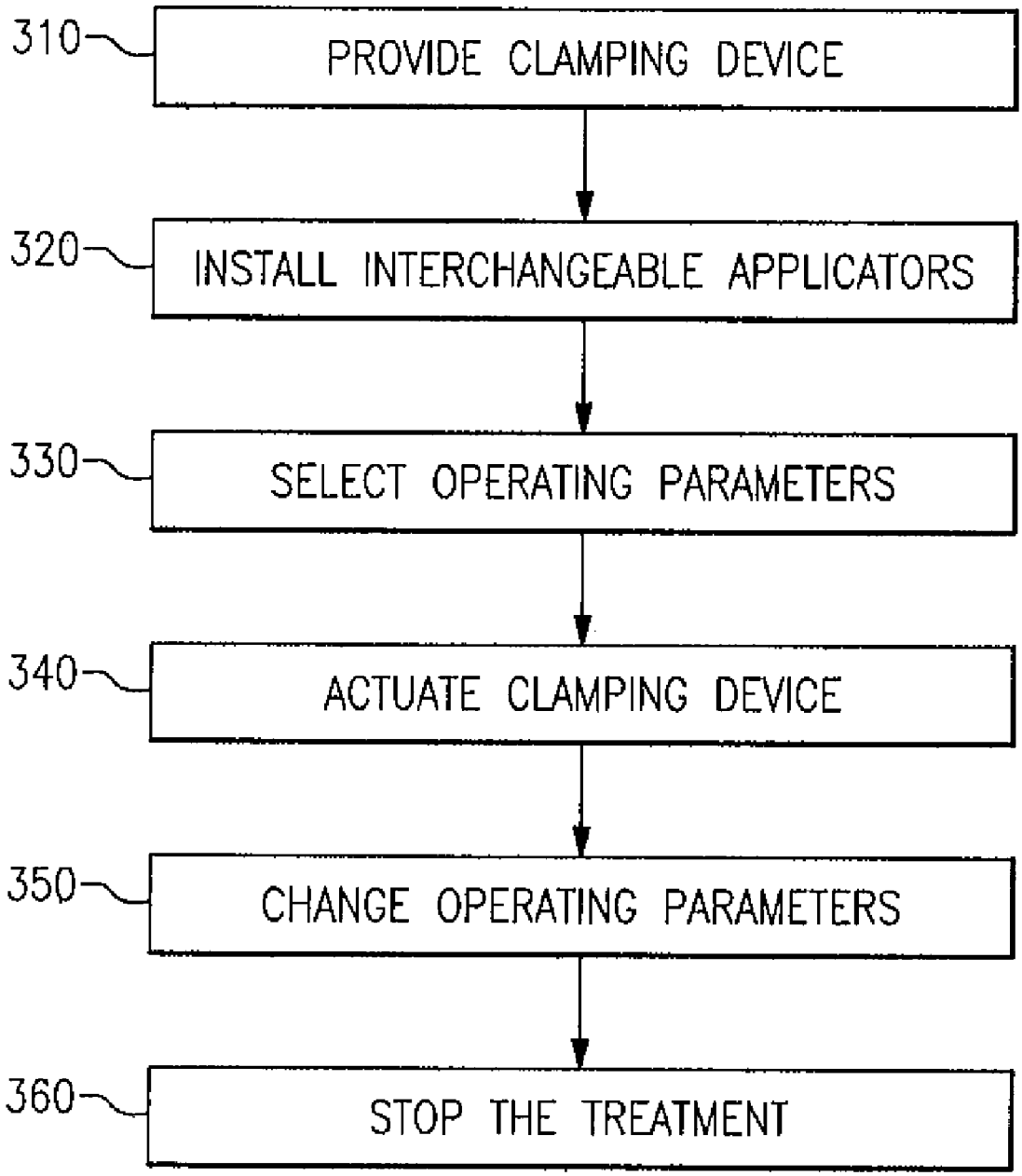
FIG. 3 illustrates a flow chart of one embodiment of the method of performing stimulating therapy according to the present invention.

In another aspect, there is provided a method of performing stimulating therapy using the clamping device according to the present invention. The flowchart of one embodiment of the method is shown in FIG. 3.

At step 310, a clamping device for therapeutic applications can be provided. One embodiment of the device is described herein supra with references to FIG. 1.

At step 320, at least one applicator 112*a*-112*b* can be removably mounted to the stationary jaw 106 of the C-shaped clamp 104 and/or to the movable member 110 of the linear actuator 108. In one aspect, the operator of the clamping device can select and install the applicators having a configuration most suitable for the currently performed task, as described herein supra.

At step 330, one or more operating parameters of the clamping device can be selected. In one aspect, the operator can select the level of pressure to be applied by the applicators 112*a*-112*b* to the targeted body area.

In another aspect, the operator can select the maximum level of pressure not to be exceeded by the clamping device, using, e.g., a switch having two or more positions corresponding to various pressure levels.

In a further aspect, the operator can select the temperature of the heated applicators 112*a*-112*b*.

In a further aspect, the operator can select the vibration parameters of the applicators 112*a*-112*b*, as described herein supra.

At step 340, the clamping device can be actuated by the operator using the switch 116 of FIG. 1.

At step 350, one or more operating parameters can be changed, e.g., upon expiration of a pre-defined timeout or responsive to the client's reactions.

At step 360, the operator of the clamping device can stop the treatment, e.g., upon expiration of a pre-defined timeout or responsive to the client's reactions, by reversing the linear actuator and removing the clamping device from the targeted body area. de-actuate the actuator to stop the treatment.

While the present invention has been particularly shown and described with reference to certain exemplary embodiments, it will be understood by a skilled artisan that various changes in detail may be affected therein without departing from the spirit and scope of the invention as defined by claims that can be supported by the written description and drawings. Further, where exemplary embodiments are described with reference to a certain number of elements it will be understood that the exemplary embodiments can be practiced utilizing less than the certain number of elements.

What is claimed is:

1. A clamping device for therapeutic applications comprising:

an extended handle adapted to facilitate a secure grip of said clamping device by a hand of an operator;

a powered linear actuator mounted to said extended handle, said actuator including a movable member, said actuator configured to provide reversible axial movement of said movable member;

a C-shaped clamp attached to said extended handle, said clamp including a stationary jaw;

a first applicator attached to said stationary jaw;

a second applicator attached to said movable member;

a switching means coupled to said linear actuator, said switching means configured to control said linear actuator;

wherein said first applicator and said second applicator are made of an hypoallergenic material configured not to cause an adverse reaction when applied to a human skin; and wherein said linear actuator is configured, responsive to switching said switching means, to axially move said second applicator in a direction selected from the group consisting of: towards said first applicator, away from said first applicator, so that to apply pressure to a targeted body area.

2. The device of claim 1, wherein said device is configured to be used to simulate a pincer grip movement by a massage therapist.

3. The device of claim 1, wherein said linear actuator is selected from the group consisting of: an electrically powered linear actuator, a pneumatically driven linear actuator, and a hydraulically driven linear actuator.

4. The device of claim 1, wherein said first applicator is removably attached to said stationary jaw; and wherein said second applicator is removably attached to said movable member.

5. The device of claim 1, wherein said device is configured so that said first applicator and said second applicator apply a pre-selected level of pressure to said targeted body area.

6. The device of claim 1, wherein said device is configured to measure pressure applied to said targeted body area.

7. The device of claim 1, wherein at least one of: said first applicator and said second applicator is configured to be heated to a pre-defined temperature.

8. The device of claim 1, wherein at least one of: said first applicator, said second applicator is configured to vibrate with a pre-defined frequency.

9. The device of claim 1 configured not to exceed a pre-defined maximum level of pressure applied to said targeted body area.

10. The device of claim 1, wherein said switching means is provided by an electric switch having two or more positions for initiating reversible movement of said movable member in two opposite directions.

11. The device of claim 1, wherein said hypoallergenic material is provided by a material selected from the list consisting of: an elastomeric material, plastic, rubber, ceramic, and silicone.

12. The device of claim 1 further comprising an electrical nerve stimulation unit including one or more electrical signal generators and a plurality of electrodes, each of said electrodes being attached to one of: said first applicator, said second applicator.

13. The device of claim 1 configured to employ an external electrical nerve stimulation unit, wherein said device further comprises a plurality of electrodes, each of said electrodes being attached to one of: said first applicator, said second applicator, each of said electrodes being electrically coupled to a sockets configured to receive a plug electrically coupled to said external electrical nerve stimulation unit.

14. A method of performing stimulating therapy comprising the steps of:

providing a clamping device for therapeutic applications, said clamping device comprising a powered linear actuator including a movable member, a C-shaped clamp including a stationary jaw, a switching means coupled to said linear actuator, said linear actuator configured to provide reversible axial movement of said movable member;

selecting at least one of: a first applicator and a second applicator, said first applicator and said second applicator made of an hypoallergenic material configured not to cause an adverse reaction when applied to a human skin;

removably mounting at least one of: said first applicator to said stationary jaw, said second applicator to said movable member;

using said switching means, actuating said linear actuator to axially move said second applicator in a direction selected from the group consisting of: towards said first applicator, away from said first applicator, so that to apply pressure to a targeted body area.

15. The method of claim 14 further comprising a step of selecting at least on one operating parameter of said clamping device, preceding the step of actuating said linear actuator.

16. The method of claim 14 further comprising a step of selecting at least on one operating parameter of said clamping device, preceding the step of actuating said linear actuator;

wherein said at least one operating parameter is selected from the group consisting of: a level of pressure to be applied to said targeted body area; a maximum level of pressure not to be exceeded by said clamping device; and a parameter of vibration of at least one of: said first applicator, said second applicator.

17. The method of claim 14 further comprising a step of changing at least on one operating parameter of said clamping device, responsive to at least one of: an expiration of a pre-defined timeout, a client reaction.

18. The method of claim 14 further comprising a step of changing at least on one operating parameter of said clamping device, responsive to at least one of: an expiration of a pre-defined timeout, a client reaction;

wherein said at least one operating parameter is selected from the group consisting of: a level of pressure to be applied to said targeted body area; a maximum level of pressure not to be exceeded by said clamping device; and a parameter of vibration of at least one of: said first applicator, said second applicator.

19. The method of claim 14 further comprising a step of de-actuating said linear actuator, responsive to at least one of: an expiration of a pre-defined timeout, a client reaction.

* * * * *